US009687880B2

(12) United States Patent
Schneider et al.

(10) Patent No.: US 9,687,880 B2
(45) Date of Patent: Jun. 27, 2017

(54) DEDUSTING APPARATUS HAVING ACTUATOR CONTROLLED INLET DEFLECTORS TO PROVIDE ADJUSTABLE PRODUCT FLOW REGULATION

(71) Applicant: Pelletron Corporation, Lancaster, PA (US)

(72) Inventors: Heinz Schneider, Lancaster, PA (US); Joseph T. Lutz, West Chester, PA (US)

(73) Assignee: Pelletron Corporation, Lancaster, PA (US)

( * ) Notice: Subject to any disclaimer, the term of this patent is extended or adjusted under 35 U.S.C. 154(b) by 179 days.

(21) Appl. No.: 14/595,406

(22) Filed: Jan. 13, 2015

(65) Prior Publication Data

US 2015/0122706 A1 May 7, 2015

Related U.S. Application Data

(63) Continuation-in-part of application No. 14/189,399, filed on Feb. 25, 2014, now Pat. No. 9,302,293, which is a continuation-in-part of application No. 13/474,010, filed on May 17, 2012, now Pat. No. 8,833,563, which is a continuation-in-part of (Continued)

(51) Int. Cl.

| | |
|---|---|
| ***B07B 4/00*** | (2006.01) |
| ***B07B 4/08*** | (2006.01) |
| ***B07B 4/02*** | (2006.01) |
| ***B07B 7/04*** | (2006.01) |
| ***B07B 7/06*** | (2006.01) |
| *B07B 11/06* | (2006.01) |

(52) U.S. Cl.
CPC ..... *B07B 4/08* (2013.01); *B07B 4/02* (2013.01); *B07B 7/04* (2013.01); *B07B 7/06* (2013.01); *B07B 11/06* (2013.01)

(58) Field of Classification Search
CPC .... B07B 4/00; B07B 4/02; B07B 4/04; B07B 4/06; B07B 4/08; B07B 7/00; B07B 7/04; B07B 7/06; B07B 11/06
USPC ..... 209/39, 133, 136–141, 145, 149
See application file for complete search history.

(56) References Cited

U.S. PATENT DOCUMENTS

| | | | |
|---|---|---|---|
| 5,035,331 | A | 7/1991 | Paulson |
| 6,595,369 | B2 | 7/2003 | Paulson |
| 7,380,670 | B2 | 6/2008 | Paulson et al. |

(Continued)

*Primary Examiner* — Joseph C Rodriguez
*Assistant Examiner* — Kalyanavenkateshware Kumar
(74) *Attorney, Agent, or Firm* — Miller Law Group, PLLC

(57) ABSTRACT

A dedusting apparatus is provided with movable inlet deflectors that are positionally controlled by actuators to vary the rate of flow of particulate material over the wash decks. The inlet deflectors are formed with a fixed member that extends between the front and rear walls of the dedusting apparatus and extends downwardly from the top wall to terminate in a spaced relationship to the surface of the wash decks. A movable member is operatively coupled to an actuator to overlie the fixed member and be movable to be adjacent the surface of the wash deck to terminate flow of material past the deflectors. Particulate material can accumulate above the wash decks and between the deflectors to fill the volume to the inlet opening to permit a full loading of flow over the full width of the wash decks when the deflectors are raised by the actuators.

17 Claims, 7 Drawing Sheets

Related U.S. Application Data application No. 13/041,678, filed on Mar. 7, 2011, now Pat. No. 8,931,641.

(60) Provisional application No. 61/319,251, filed on Mar. 30, 2010, provisional application No. 61/489,460, filed on May 24, 2011.

(56) References Cited

U.S. PATENT DOCUMENTS

| | | | | |
|---|---|---|---|---|
| 8,016,116 | B2 | 9/2011 | Schneider | |
| 2011/0308437 | A1* | 12/2011 | Latta | B07B 7/01 209/240 |

* cited by examiner

DEDUSTING APPARATUS HAVING ACTUATOR CONTROLLED INLET DEFLECTORS TO PROVIDE ADJUSTABLE PRODUCT FLOW REGULATION

CROSS-REFERENCE TO RELATED APPLICATIONS

This application is a continuation-in-part of U.S. patent application Ser. No. 14/189,399, filed Feb. 25, 2014, granted as U.S. Pat. No. 9,302,293 on Apr. 5, 2016, which is a continuation-in-part of U.S. patent application Ser. No. 13/474,010, filed on May 17, 2012, granted as U.S. Pat. No. 8,833,563 on Sep. 16, 2014, which is a continuation-in-part of U.S. patent application Ser. No. 13/041,678, filed on Mar. 7, 2011, granted as U.S. Pat. No. 8,931,641 on Jan. 13, 2015, and claims domestic priority on U.S. Provisional Patent Application Ser. No. 61/319,251, filed Mar. 30, 2010, and on U.S. Provisional Patent Application Ser. No. 61/489,460, filed on May 24, 2011, the contents of which are incorporated herein by reference.

FIELD OF THE INVENTION

The invention disclosed in this application is directed generally to an apparatus for the cleaning and handling of particulate materials, such as plastic pellets, grains, glass, and the like, and particularly to the a dedusting apparatus that has actuator controlled inlet deflectors to close the flow of particulate material over opposing wash decks.

BACKGROUND OF THE INVENTION

It is well known, particularly in the field of transporting and using particulate materials, commonly powders, granules, pellets, and the like, that it is important to keep product particles as free as possible of contaminants. Particulates are usually transported within a facility where they are to be mixed, packaged or used in a pressurized tubular system that in reality produces a stream of material that behaves somewhat like a fluid. As these materials move through the pipes, considerable friction is generated not only among the particles themselves, but also between the tube walls and the particles in the stream. In turn, this friction results in the development of particle dust, broken particles, fluff, streamers (ribbon-like elements that can "grow" into quite long and tangled), glass fibers in glass filled products, that can impede the flow of materials. The characteristics of such a transport system are quite well known, as is the importance and value of keeping product particles as free as possible of contaminants.

The term "contaminant" as used herein includes a broad range of foreign material and includes foreign material as well as broken particles or streamers of the product being transported. The generation of contaminants, also referred to as dust, including microdust, can be from a large number of sources, including, in the way of examples, the creation of dust particles during the processing of plastic pellets in which the larger particles are segregated to be re-ground; organic matter in food grains, such as shells and hulls; the creation of dust in the formation of iron ore pellets; and, as noted previously, the mere conveyance of the pellets in pipes and other mechanical conveying and handling systems. Using plastics as an example, such foreign material could have a detrimental effect on the finished product. Specifically, foreign material different in composition from the primary material, such as dust, and non uniform material of the primary product, such as streamers, would not necessarily have the same melting temperatures as the primary product and would cause flaws when the plastics material is melted and molded. Furthermore, streamers can impact the weighing scale and plug the dosing screws at bagging stations.

Considering product quality, and focusing on moldable plastics as a primary example, foreign material different in composition from the primary material, such as dust, non-uniform material of the primary product, fluff, and streamers, does not necessarily have the same melting temperatures as the primary product and causes flaws when the material is melted and molded. These flaws result in finished products that are not uniform in color, may contain bubbles, and often appear to be blemished or stained, and are, therefore, unsellable. It is important to note that since these same non-uniform materials often do not melt at the same temperature as the primary product, the unmelted contaminants cause friction and premature wear to the molding machines, resulting in downtime, lost production, reduced productivity, increased maintenance and thus increased overall production costs.

Since dust and other contaminants are generated mostly by the transport system, it is of primary importance to not only provide apparatus for thoroughly cleaning the particles, but to do so as close to the point of use of the particles as possible so as to avoid the generation of contaminants through additional transport. Accordingly, compact dedusters have been used for many years to clean materials in this application, capable of handling smaller volumes of product, yet also capable of thoroughly cleaning the product. The compact dedusters permit the installation of the deduster immediately before final use of the products, such as being installed directly on top of molding machines or extruders, or on top of silos, as well as under silos, before packaging and bagging, rather than at an earlier stage after which re-contamination can occur before the products are utilized. Of course, the dedusters can be installed as a free standing unit, as well.

Dedusters used to clean contaminants from particulate material can be found in U.S. Pat. No. 5,035,331, granted to Jerome I. Paulson on Jul. 30, 1991, in which air is blown upwardly through wash decks over which a flow of contaminated particulate material is passed so that the flow of air up through the wash decks removes the contaminants from the material flow. A magnetic field is provided by the deduster so that the particulate material flow passes through the magnetic field to neutralize the static charge on the particulates and facilitate the removal of the contaminants from the material. The flow of contaminant laden air is discharged from the deduster, while the cleaned particulate material is passed on to the manufacturing process.

A compact dedusting apparatus is disclosed in U.S. Pat. No. 6,595,369, granted on Jul. 22, 2003, to Jerome I. Paulson. Like the larger dedusting apparatus depicted in U.S. Pat. No. 5,035,331, the follow of particulate material is cleansed of contaminates that have had the static charged attracting the contaminates to the particulates neutralized. The cleaning process utilizes a flow of air passing through the stream of particulate material passing over wash decks. The contaminate-laden air is discharged through the top of the dedusting apparatus, while the cleaned particulate material is discharged from the bottom of the deduster.

In U.S. Pat. No. 7,380,670, granted on Jun. 3, 2008, to Jerome I. Paulson, et al, and in U.S. Pat. No. 8,016,116, granted on Sep. 13, 2011, to Heinz Schneider, the dedusting apparatus includes a pair of oppositely directed wash decks receiving contaminated particulate material from a common infeed port. The infeed mechanism divides the material flow between the two opposing wash decks and directs the particulate material over a flow of air passing through the first wash decks, then through laterally spaced Venturi zones and onto inwardly directed secondary wash decks that direct the cleaned particulate material into a central discharge opening. Air flow to the primary and secondary wash decks is directed through a rearwardly located manifold that has a central primary opening and laterally spaced lower openings below the secondary wash decks.

These compact dedusters are provided with single, offset and double (back-to-back) wash decks and are utilized with a vertically oriented conduit in which particulate material is conveyed to the manufacturing apparatus utilizing the particulate material. Accordingly, the product inlet opening at the top of the dedusting apparatus is in vertical alignment with the cleaned product outlet opening. The particulate material is introduced into the inlet opening and is metered onto a diagonally oriented primary wash deck through which air is blown from an air supply inlet to clean dust and debris from the particulate material flowing over the wash deck. In these dedusting devices, the particulate material is discharged off the lower end of the wash deck and falls through a Venturi zone in which air is moving upwardly to provide a vigorous cleaning action to the particulate material. The material falling through the Venturi zone is received on a secondary wash deck that is oriented oppositely of the primary wash deck to direct material back to the centrally aligned cleaned product outlet opening.

With increasing capacity of the dedusting apparatus, it would be advantageous to provide for a fully balanced distribution of the inflow of particulate material to be cleaned over the opposing wash decks of the dedusting apparatus, or in the offset dedusting apparatus, an even flow over the full width of the wash deck. In conventional dedusting devices, the flow of particulate material onto the wash decks typically passes through a rotary valve and then through a circular inlet opening onto rectangular wash decks. As a result, even flow over the full width of the wash decks is not usually accomplished.

It would be advantageous to provide a configuration for a dedusting apparatus that enables a uniform distribution of the particulate material to be cleaned over the full width of the wash decks. It would also be advantageous to be able to terminate selectively the flow of particulate material over the wash decks. In addition, it would be advantageous to provide a configuration for a dedusting apparatus that enables the rotary valve to be eliminated from the overall combination of components while passing the infeed of particulate materials through a circular infeed opening.

SUMMARY OF THE INVENTION

It is an object of this invention to overcome the disadvantages of the prior art by providing an apparatus for removing dust and debris from particulate material having an inlet structure that will provide a balanced flow of particulate material over the opposing wash decks for the cleaning of the particulate material.

It is another object of this invention to provide a dedusting apparatus that accomplishes a uniform distribution of material over the full width of the wash decks while utilizing a circular inlet port.

It is a feature of this invention that the dedusting apparatus establishes a fully loaded inlet structure to provide a balanced distribution of the particulate material over the opposing wash decks.

It is another feature of this invention that the use of actuator controlled inlet deflectors allows the distribution of particulate material over the full width of the wash decks.

It is still another feature of this invention that the utilization of actuator controlled inlet deflectors can terminate the flow of particulate material over the wash decks to allow the material to accumulate above the inlet deflectors into a rectangular inlet configuration that provides a uniform flow over the wash decks.

It is an advantage of this invention that the inlet deflectors can be individually positioned to provide a preselected flow of particulate material over the opposing wash decks in a balanced, equally distributed manner, or over a single wash deck for an offset dedusting apparatus.

It is still another feature of this invention that the inlet deflectors are controlled through actuators that can be coupled to a computer for automatic positioning of the inlet deflectors relative to the surface of the wash decks to control the flow of material over the surface of the wash decks.

It is still another object of this invention to provide an independent control of the flow of particulate material over each of the two opposing wash decks in the dedusting apparatus, or control the flow over a single wash deck.

It is still a further feature of this invention that the inlet deflectors are individually adjustable to regulate the flow of particulate material over the upper surface of each respective wash deck.

It is still a further advantage of this invention that the individually adjustable, actuator controlled inlet deflectors are operable to close the operation of one or both of the wash decks.

It is yet a further advantage of this invention that the controls provided through the individually adjustable inlet deflectors eliminates the need to provide a rotary valve in conjunction with the feeding of particulate material into a dedusting apparatus.

It is another feature of this invention that the inlet deflectors are formed with a fixed member that extends downwardly from the upper surface of the housing of the dedusting apparatus and terminates in a spaced relationship to the corresponding wash deck.

It is still another feature of this invention that the inlet deflectors are also formed with a movable member that rests on the fixed member and is movable relative to the fixed member and the surface of the corresponding wash deck.

It is still another advantage of this invention that the movable member of the inlet deflector is moved through operation of an actuator.

It is a further object of this invention that the movable members of the inlet deflectors can be positioned adjacent to the surface of the wash decks to terminate the flow of particulate material over the wash deck surface.

It is a further advantage of this invention that the termination of the flow of particulate material over the surface of the wash decks allows the particulate material to accumulate above the inlet deflectors to fill the housing of the dedusting apparatus above the wash decks and between the opposing inlet deflectors.

It is still a further advantage of this invention that the accumulated particulate material will be fully loaded for distribution over the entire width of the wash decks after passing beneath the inlet deflectors which can be located to provide the requisite flow rate of particulate material over the wash decks.

It is further object of this invention to provide actuator controlled inlet deflectors for a dedusting apparatus, which is durable in construction, inexpensive of manufacture, carefree of maintenance, facile in assemblage, and simple and effective in use.

These and other objects features and advantages are accomplished according to the instant invention by providing a dedusting apparatus is provided with movable inlet deflectors that are positionally controlled by actuators to vary the rate of flow of particulate material over the wash decks. The inlet deflectors are formed with a fixed member that extends between the front and rear walls of the dedusting apparatus and extends downwardly from the top wall to terminate in a spaced relationship to the surface of the wash decks. A movable member is operatively coupled to an actuator to overlie the fixed member and be movable to be adjacent the surface of the wash deck to terminate flow of material past the deflectors. Particulate material can accumulate above the wash decks and between the deflectors to fill the volume to the inlet opening to permit a full loading of flow over the full width of the wash decks when the deflectors are raised by the actuators.

BRIEF DESCRIPTION OF THE DRAWINGS

The advantages of this invention will become apparent upon consideration of the following detailed disclosure of the invention, especially when taken in conjunction with the accompanying drawings wherein.

DETAILED DESCRIPTION OF THE PREFERRED EMBODIMENT

Figure 1:
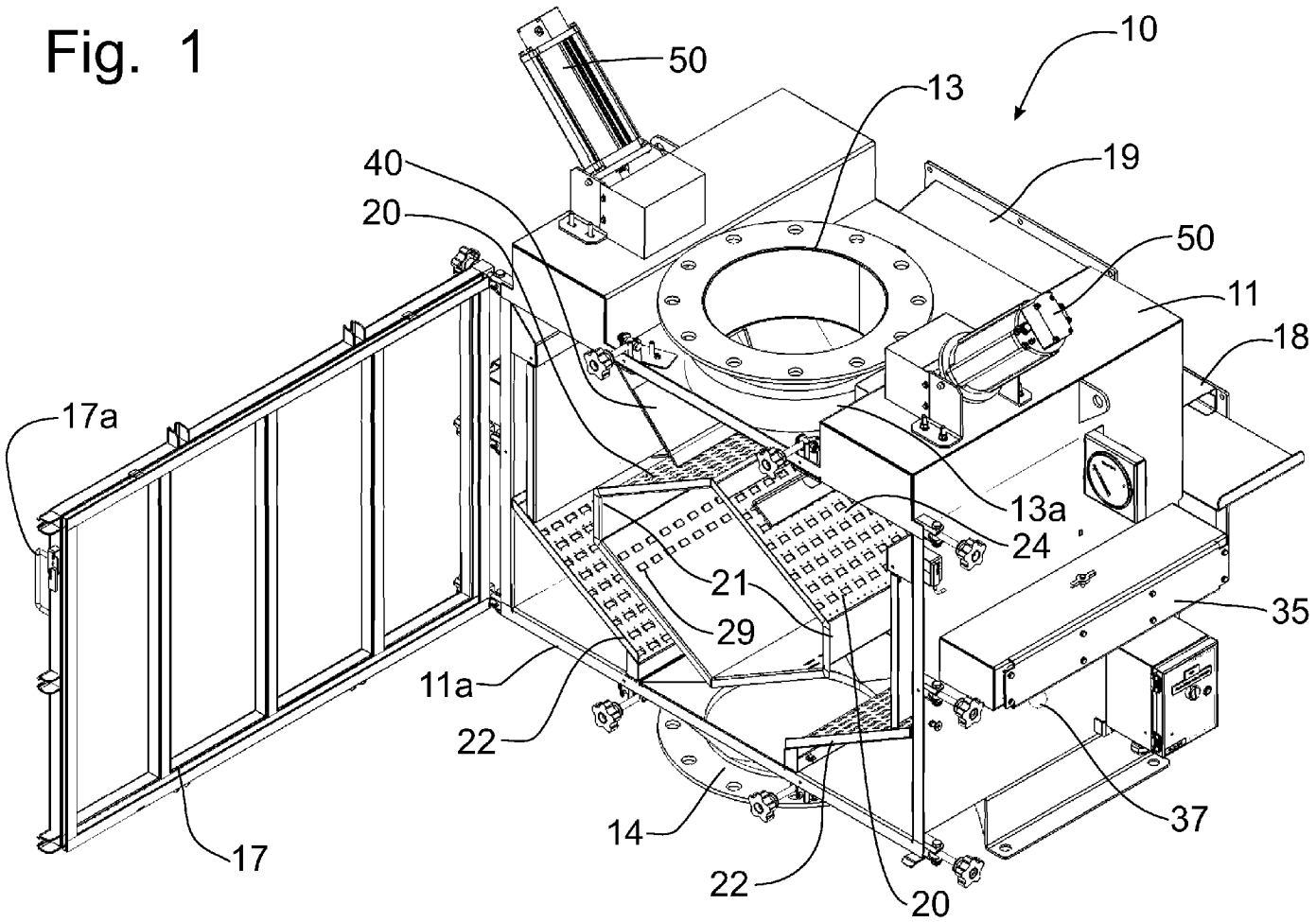
FIG. 1 is a front perspective view of a dedusting apparatus incorporating the principles of the instant invention.
Figure 2:
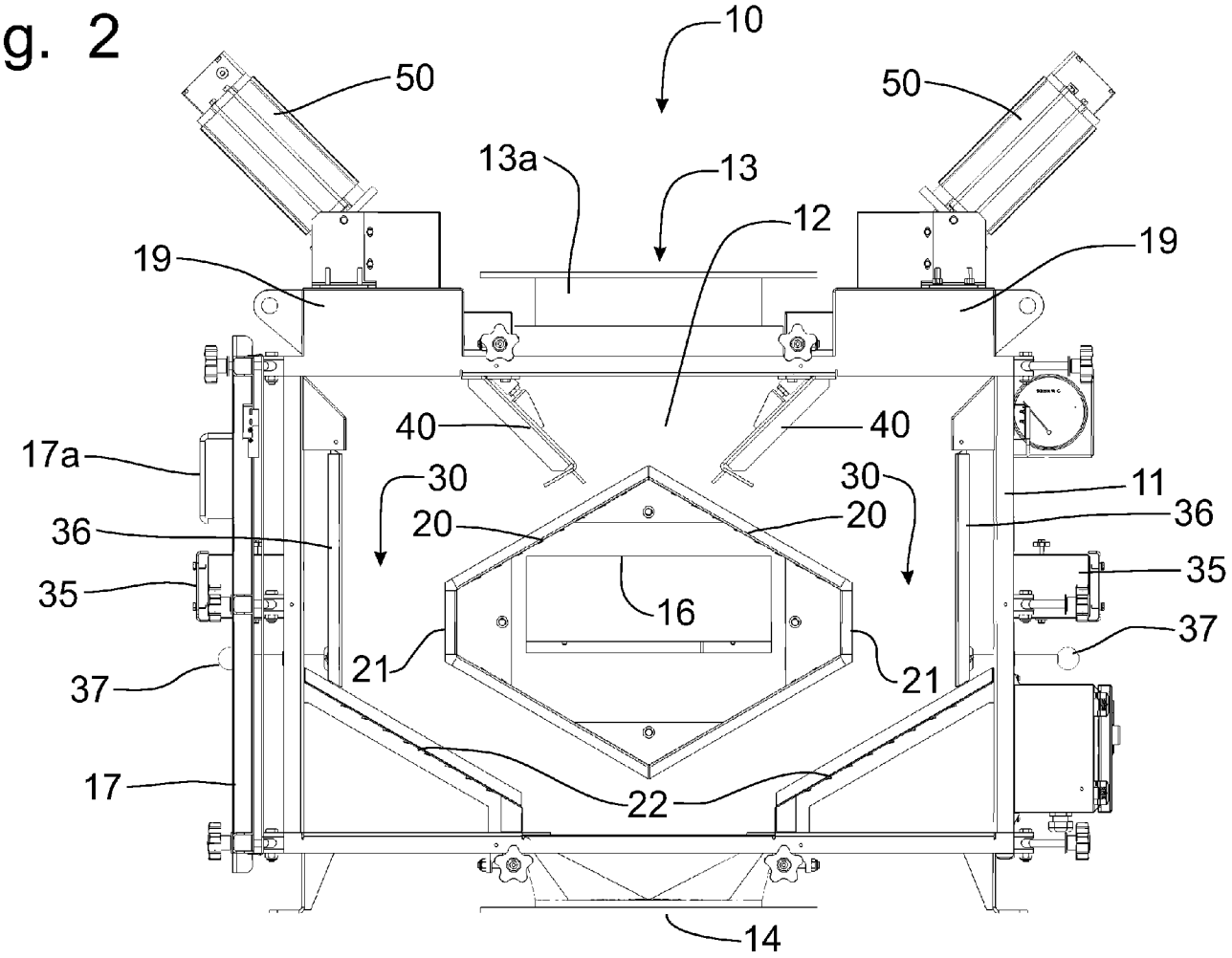
FIG. 2 is a schematic front elevational view of the dedusting apparatus shown in FIG. 1, the inlet deflectors being positioned at a raised position to permit flow of material over the wash decks.
Figure 3:
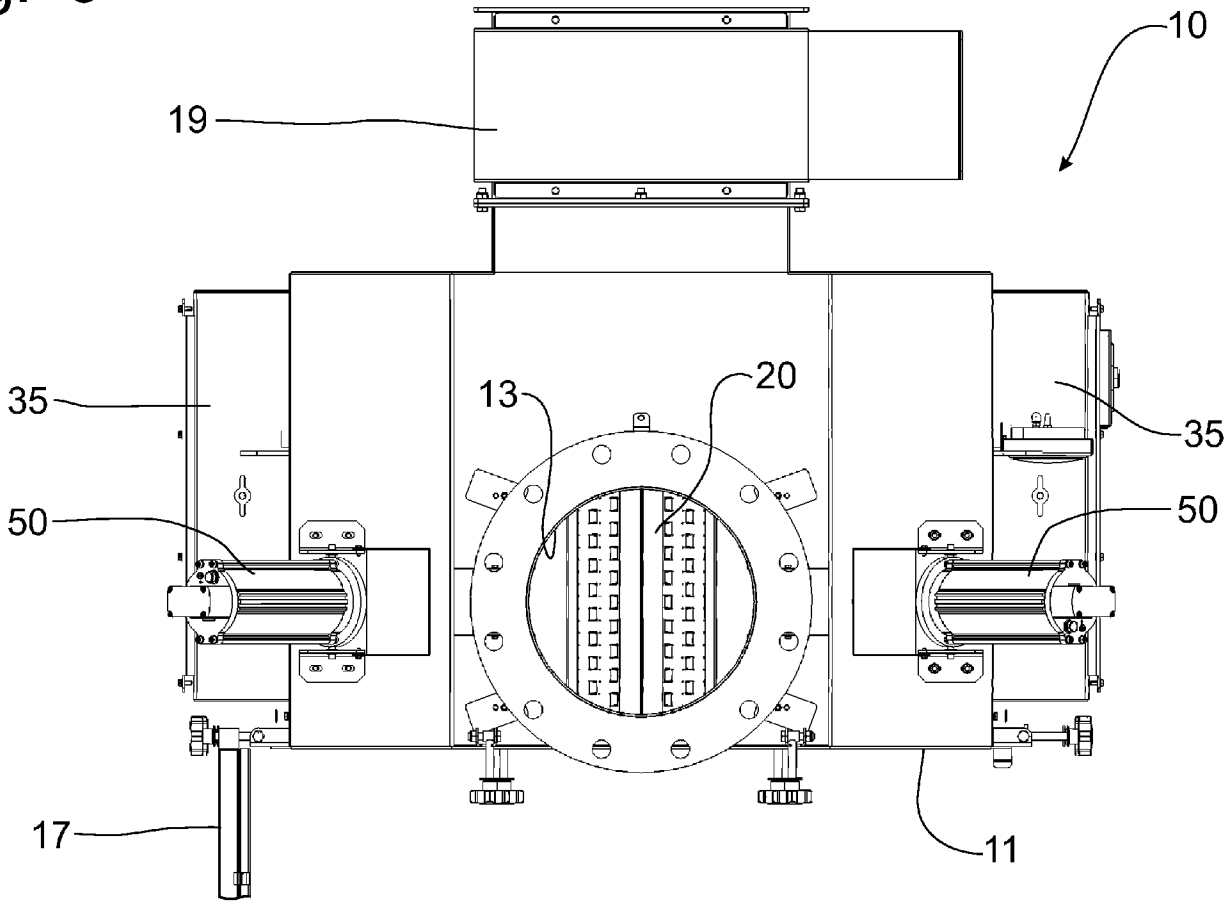
FIG. 3 is a top plan view of the dedusting apparatus shown in FIG. 1.
Figure 4:
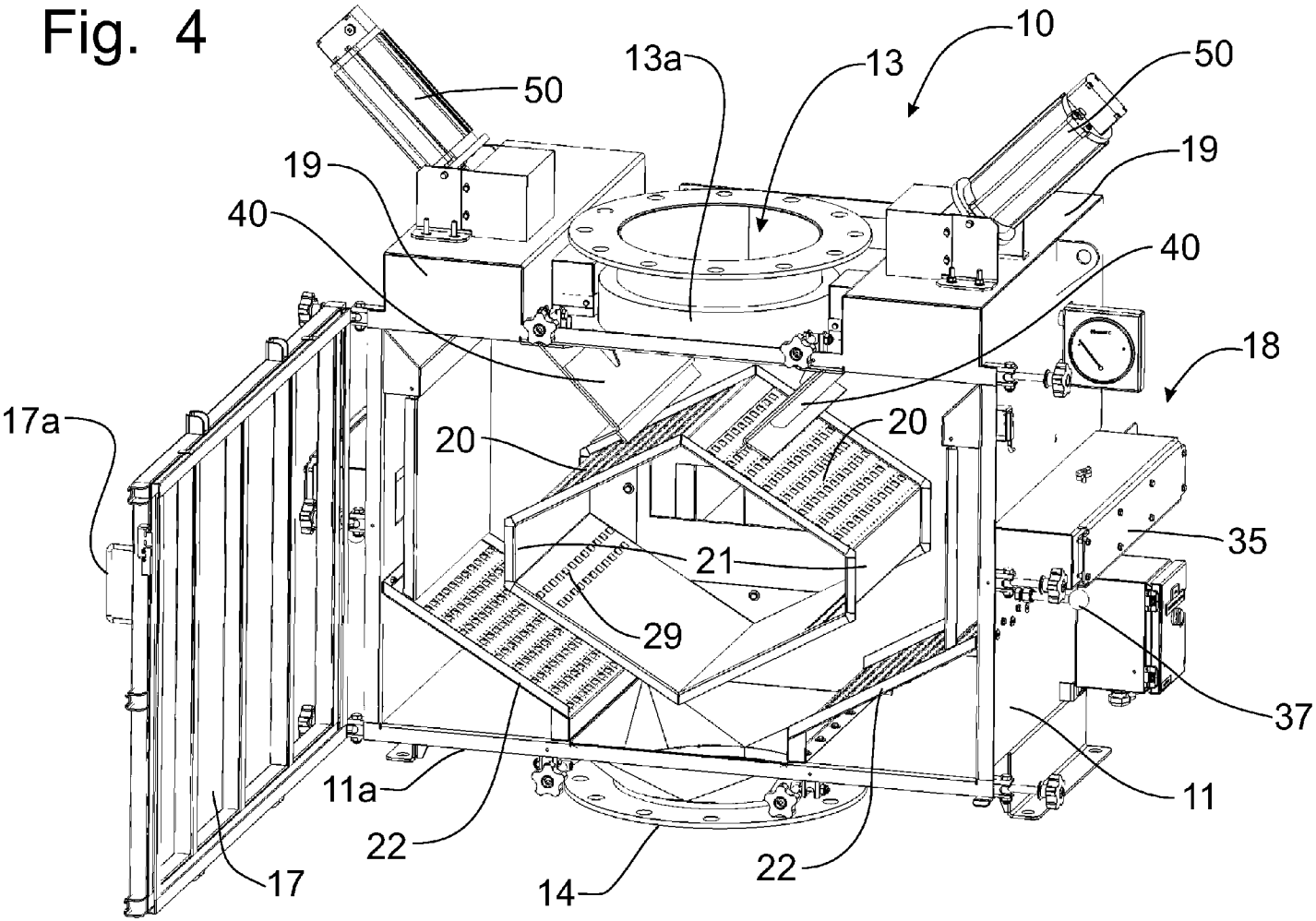
FIG. 4 is a perspective view of the dedusting apparatus shown in FIG. 1.

The dedusting apparatus is known in the art. A general description of the structure and operation of a conventional dedusting apparatus and a conventional compact dedusting apparatus can be found in U.S. Pat. No. 5,035,331 and in U.S. Pat. No. 6,595,369, both of which were issued to Jerome I. Paulson, the contents of each of these patents being incorporated herein by reference. Typical particulate material to be cleaned by the dedusting apparatus 10 is plastic pellets that are to be passed into an injection molding machine to form plastic components. Examples of plastic particulate material that can be cleaned of contaminate material by the dedusting apparatus 10 are polyester, acrylic, high density polyethylene, polypropylene, nylon, polycarbonates, styrene, and low density polyethylene. Any type of granular dry bulk materials such as minerals, foods, pharmaceuticals and others can be cleaned in the dedusting apparatus 10.

Referring to FIGS. 1-4, the dedusting apparatus 10, incorporating the principles of the instant invention, defines a central product inlet port 13 that is typically connected to a vertical portion of a fluent material handling system (not shown) such that the particulate material is fed into a product inlet port 13 located at the transverse center at the top of a generally airtight main housing 11. The main housing 11 supports a pair of oppositely directed wash decks 20 that receive particulate material to be cleaned from the inlet port 13, as will be described in greater detail below. The main housing also defines an air inlet passageway 15 having an air inlet port 16 in the rear wall 12 of the housing 11. As will be described in greater detail below, the introduction of an air flow through the air inlet port 16 will direct air through the wash decks 20 to clean the particulate material.

The product inlet port 13 directs product particulates onto the wash decks 20 for cleaning. A magnetic coil 13*a* generates a magnetic flux field and is mounted at the inlet port 13 so that the flow of particulate material into the main housing 11 to be cleaned is subjected to the magnetic flux field to neutralize the static charges on the particulate pellets, thus making the separation of the contaminates, particularly microdust, from the pellets easier to accomplish. Air is fed into the housing 11 through the clean air inlet port 16 through the rear wall 12 to direct a flow of clean air into the housing 11, as will be described in greater detail below. A portion of the clean air passing through the inlet opening 16 is directed upwardly through the wash decks 20, while a remaining portion of the clean air flowing into the housing 11 is distributed to the Venturi zones 30, as will be described in greater detail below.

The wash decks 20 are supported by the housing 11 between the front wall 17 and the rear wall 12 to present a downwardly sloping surface in opposite directions from the product inlet port 13 to the discharge ends of the wash decks 20 over which the product to be cleaned, in the form of particulate particles, moves by gravity. The particulate material falls through the Venturi zones 30 and lands on the secondary wash decks 22 where an additional cleansing air flow is encountered by the particulate material before being passed to the product outlet port 14.

A pair of inlet deflectors 40 is mounted to the housing 11 in a manner to be described in greater detail below. The inlet deflectors 40 control the flow of material over the surface of the upper wash decks 20. The greater the gap between the inlet deflector 40 and the wash deck, the higher the flow rate will be. The inlet deflector 40 includes a trailing leg 46 that is oriented generally parallel to the slope of the wash deck 20 to force the product particulates into a laminar flow downwardly over the surface of the wash deck 20 toward the Venturi zone 30 after passing the inlet deflector 40.

The wash deck 20 is formed as a sloped tray having a top surface 24 in which are formed generally horizontal slots 25 and circular openings. The horizontal slots 25 are formed in conjunction with an upwardly extending deflector that presents a ramp to the product particulates moving downwardly over the top surface 24 of the wash deck 20. The slot 25 is formed as the horizontal opening across the top surface 24 between the deflector and the top surface 24, such that the air flowing through the slot 25 is directed by the deflector into the product in a generally horizontal direction, which is slightly upwardly with respect to the slope of the top surface 24 of the wash deck 20. Air moving through the circular openings is directed generally perpendicularly to the sloped top surface 24 of the wash deck 20.

The net operative result is that the product particulates are subjected to a downward acceleration along the surface of the wash deck and to a turbulence generated by the movement of the particulates over the deflectors and by the substantially perpendicular air flow streams emanating from the circular openings and the horizontal slots 25. Accordingly, dust and debris contaminates are released from the product particulates and are carried by the air flow to the dirty air exhaust port 19 at the top of the housing 11.

The product particulates falling off of the lower discharge end 21 of the respective wash decks 20 drop generally vertically toward the corresponding secondary wash decks 22 through a Venturi zone 30 through which air is blown upwardly through the falling product particulates to provide a vigorous finally cleaning. Air is directed into the Venturi zone 30 from beneath the wash deck 20 through louvers 29 and through air passing through the secondary wash decks 22. Clean air can also be directed into the Venturi zones 30 through the bypass ducts 35. The main housing 11 is provided with a clean air plenum or manifold 18 behind the rear wall 12 and is in flow communication with the clean air inlet opening 16 to direct a flow of air into the wash decks 20, 22, and into the bypass ducts 35.

The bypass ducts 35 which direct a flow of air forwardly around the main housing 11 and back into the main housing 11 in front of the rear wall 12 to be directed behind and under the pivoted members 36 into the Venturi zones 30. The amount of air moving through the bypass ducts 35 is controlled by pivoted dampers 36 pivotally mounted in the bypass ducts 35. The size of the Venturi zones 30 and the amount of air flow directed into the Venturi zones 30 is controlled by a pivoted member 36 operatively connected to a position adjustment lever 37 projecting outside of the main housing 11.

The flow of air into the Venturi zone 30 from beneath the pivoted member 36 and through the louvers 29 presents a substantial cleaning action to the product particulates falling through the Venturi zone 30, but not so vigorous as to lift the product particulates to the dirty air exhaust port 19. If too much air is moving through the Venturi zone 30, the pivoted dampers 36 should be retracted to both increase the effective dimensions of the Venturi zone 30 and to decrease the amount of air moving into the Venturi zone 30. When the front wall 17 of the housing 11 is constructed of a transparent or semi-transparent polycarbonate, as is reflected in the drawings, the operation of the wash deck assembly 20 could be physically viewed by looking through the front wall 17 to see if product particulates were being carried over into the dirty air exhaust port 19.

The air flow in which the dust and debris contaminates are entrained is discharged from the housing 11 through the dirty air exhaust port 19 located at the top of the housing 11 above the Venturi zone 30 and on opposite sides of the product inlet port 13. The transparent front wall 17 of the housing 11 can be formed as a hinged door with a handle 17*a* to facilitate movement of the front door 17 when released from the frame 11*a*. Alternatively, the front wall 17 is not hinged and can be removed by releasing appropriate fasteners connecting the front wall 17 to the housing frame 11*a*. can be removable from the housing 11 by releasing fasteners 17*b* from the frame supports 43 connecting the frame 42 of the front wall 17 to the housing 11. With the displacement of the front wall 17, the interior components, including the wash deck 20, the inlet deflector 40, and the pivoted member 36, can be removed from the housing 11 to facilitate cleaning of the interior of the housing 11 and the removed components.

Figure 5:
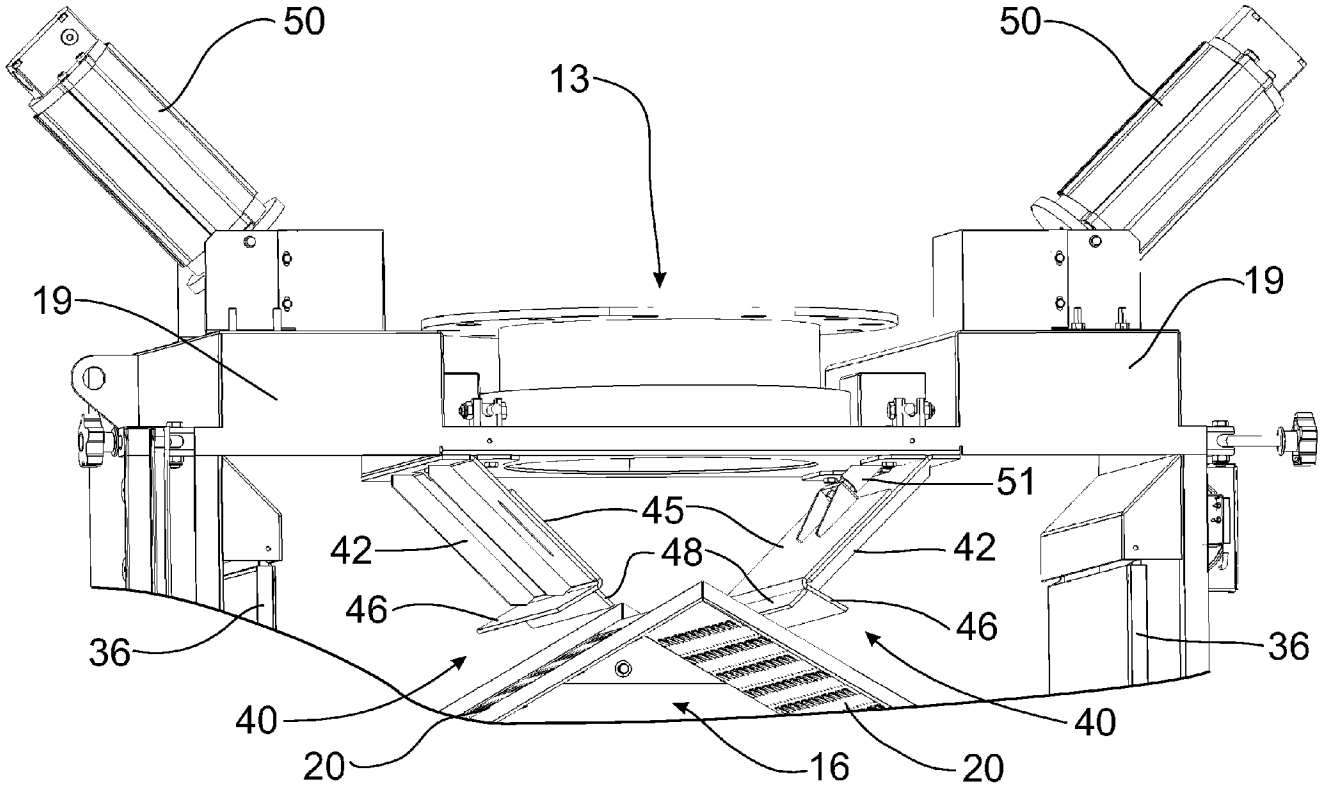
FIG. 5 is an enlarged front perspective view of the dedusting apparatus shown in FIG. 1 with the front door broken away for purposes of clarity.
Figure 6:
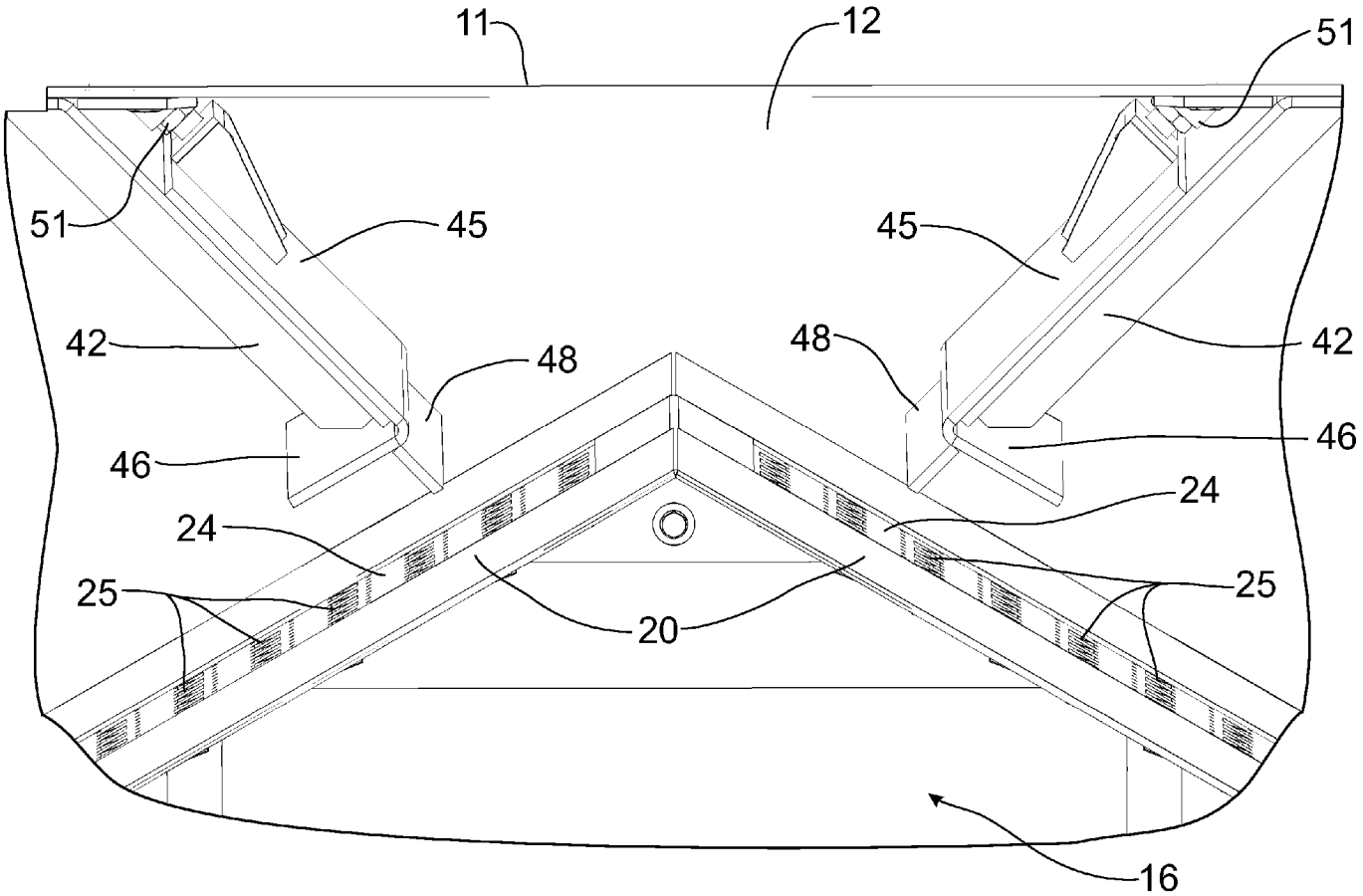
FIG. 6 is an enlarged top, front perspective view of the inlet deflectors positioned above the upper surface of the wash decks.
Figure 7:
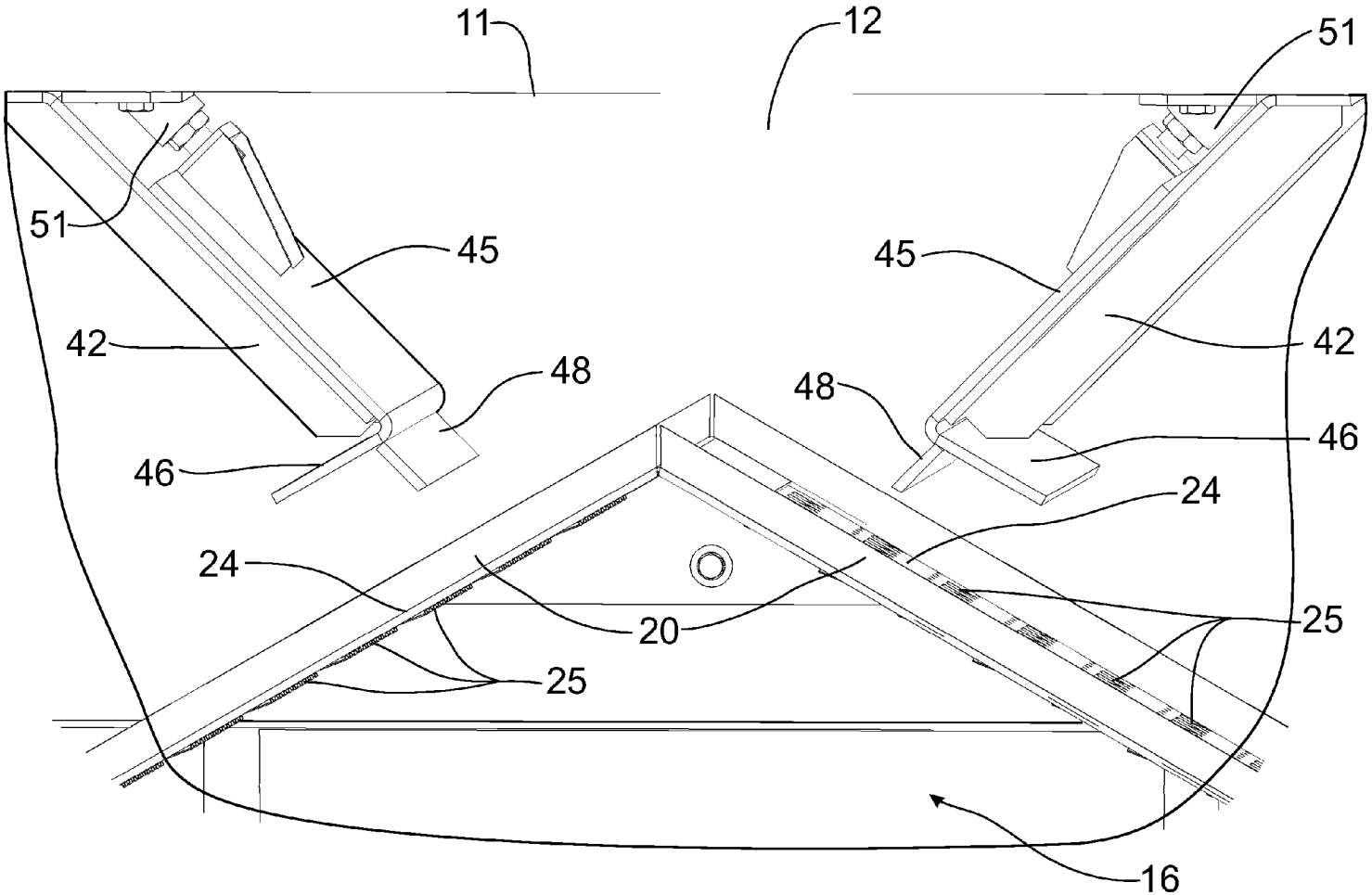
FIG. 7 is an enlarged front perspective view of the inlet deflectors similar to that of FIG. 6.

As is best seen in FIGS. 5-7, the inlet deflectors 40 are formed with a fixed member 42 that is affixed to the top of the housing 11 and extends between the front wall 17 and the central wall 17 to prevent the passage of particulate material between the fixed member 42 and the walls of the housing 11. Mounted on the fixed member 42 is a movable member 45 which also extends flush between the front wall 17 and the central wall 17, but is connected to an actuator 50 to affect movement over the surface of the fixed member 42. The movable member 45 is positionable between a maximum raised position, as depicted in the drawings, and a lowered position that is located so close to the upper surface of the wash decks 20 that the particulate material cannot pass the inlet deflectors 40. In this lowered position, the inlet deflectors 40 effectively seal off the wash decks 20 so that particulate material will accumulate and fill the volume of the housing 11 bounded by the upper portion of the wash decks 20, the laterally opposed inlet deflectors and the product inlet port 13.

In this accumulated configuration, the particulate material fully loads the wash deck between the front wall 17 and the rear wall 12 so that when the inlet deflectors 40 are raised to allow the passage of particulate material, the flow proceeds uniformly across the entire width of the wash decks 20. With the continued inflow of particulate material through the product inlet port 13, the wash decks 20 will remain fully loaded, enhancing the effectiveness of the dedusting apparatus 10. Each inlet deflector 40 includes a trailing leg 46 formed as part of the movable member 45 and is oriented parallel to the upper surface of the wash decks 20 to force the product material into a laminar flow along the wash decks 20. A linear tab 48 is affixed to the movable member 45 to project downwardly from the trailing leg 46 and serve as a flow limiting member. When the inlet deflectors 40 are in the lowered position, the linear tabs 48 are positioned closely adjacent the surface of the wash deck 20 with the trailing leg 46 spaced above the wash deck 20.

The actuators 50 can be powered by hydraulics, pneumatics or by electricity to cause an extension of the rod 51 extending therefrom and connecting to the movable member 45. The actuator rods 51 and movable members 45 are arranged to move linearly along the fixed member 42 toward and away from the wash decks 20. The actuator rods 51 are detachable from the movable members 45 and the actuators 50 can be dismounted from the housing 11 and removed from the dedusting apparatus 10 for convenience of maintenance or repair.

In operation, the dedusting apparatus 10 is installed at an appropriate location in conjunction with the desired utilization of the product outlet ports 14, and connected to a supply of particulate material through the product inlet port 13. The product particulates pass through the product inlet port 13 and are restrained from passing the inlet deflectors 40 due to the linear tabs 48 being located in the lowered position so that the particulate material can accumulate and fill the housing volume above the wash decks 20 and between the inlet deflectors 40. Once filled, the inlet deflectors 40 can be raised to the necessary height to cause the desired flow rate of the material moving past the inlet deflectors 40 and down the wash decks 20. Once past the linear tabs 48, the trailing legs 46 force the material into a laminar flow over the oppositely oriented sloped wash decks 20.

Clean air is received through a clean air inlet opening 16 and directed into the housing 11 beneath the wash decks 20 and a flow that passes through louvers 29 and through the secondary wash decks 22 pass into the Venturi zones 30. The air flowing into the housing 11 beneath the wash decks 20 passes through slots 25 and openings formed in the wash decks 20. The air passing through the slots 25 and openings in the wash decks 20 create turbulence in the product particulates moving along the top surface 24 of the respective wash decks 20. Turbulence is enhanced by the upwardly projecting deflectors projecting up from the top surface 24 and the orientation of the horizontal slots 25 which accelerates the flow of the product particulates over the wash deck 20 and further creates turbulence. This movement of air through the wash decks 20 and through the flowing product particulates removes dust and debris contaminates from the product particulates, the static attraction forces having been neutralized by the magnetic flux field induced at the product inlet port 13 by the magnetic flux generator 13*a*.

While the preferred embodiment shown in the drawings utilizes a pair of actuator controlled inlet deflectors 40 cooperable with corresponding opposing wash decks 20, the configuration of a single inlet deflector 40 formed as described above associated with a single wash deck 20 can control the flow of particulate material over the upper surface of the single wash deck 20. That single wash deck 20 can discharge to a single secondary wash deck 22 which then directs the flow of cleaned particulate material to an outlet port 14 that is aligned vertically with the inlet port 13. Also, that single wash deck 20 can discharge cleaned particulate material through a Venturi zone 30 on into an outlet port that is offset both horizontally and vertically with regard to the inlet port 13. Such an offset dedusting apparatus is depicted and described in U.S. Pat. No. 8,931,641, granted on Jan. 13, 2015, the content of which is incorporated herein by reference.

It will be understood that changes in the details, materials, steps and arrangements of parts, which have been described and illustrated to explain the nature of the invention will occur to and may be made by those skilled in the art upon a reading of this disclosure within the principles of the scope of the invention. The foregoing description illustrates the preferred embodiment of the invention; however, concepts, as based upon the description may be employed in other embodiments without departing from the scope of the invention. Accordingly, the following claims are intended to protect the invention broadly, as well as in the specific form shown.

Having thus described the invention, what is claimed is:

1. A particulate material dedusting apparatus for cleaning unwanted debris from the particulate material, comprising:

a housing;

a central infeed opening directing a flow of contaminated particulate material into the housing;

a pair of primary wash decks joined at an apex and extending downwardly and outwardly therefrom to opposing discharge edges;

an inlet deflector corresponding to each of said wash decks, each said inlet deflector having a planar configuration and being movable toward and away from the corresponding said wash deck parallel to said planar configuration to vary an spacing between said inlet deflector and the corresponding said wash deck from a maximum spacing position to a minimum spacing position, said minimum spacing position placing said inlet deflector adjacent the corresponding said wash deck to prevent the passage of contaminated particulate material past said inlet deflector without engaging said wash deck, each said inlet deflector extending between a front wall and a rear wall between which said wash deck extends, the movement of said deflectors to said minimum spacing permitting an accumulation of said contaminated particulate material between said inlet deflectors and above said wash decks, each said inlet deflector including:

a fixed member extending between said front wall and said rear wall and being mounted on a top member of said housing, said fixed member terminating in a spaced relationship with the corresponding said wash deck; and a movable member slidable along said fixed member and being connected to the corresponding said actuator to power the movement of said movable member relative to said fixed member, said movable member being positionable between said maximum spacing position and said minimum spacing position at which the passage of contaminated particulate material is not permitted past said movable member; and an actuator connected to each said inlet deflector to power movement thereof in a direction parallel to said planar configuration of said inlet deflector between said maximum spacing position and said minimum spacing position.

2. The apparatus of claim 1 wherein each said movable member comprises:

a planar portion supported on said fixed member and being oriented parallel thereto;

a trailing leg extending downwardly from said planar portion and being oriented generally parallel to said wash deck, said trailing leg being operable to direct the particulate material into a laminar flow once said particulate material has moved past said planar portion; and a linear tab extending generally parallel to said planar portion from said trailing leg to be positionable adjacent said wash deck to define a gap relative to said wash deck when said movable member is moved relative to said fixed member.

3. The apparatus of claim 2 wherein each said fixed member is oriented diagonally relative to said housing such that said linear tab is movable toward and away from the corresponding said wash deck at substantially right angles thereto.

4. The apparatus of claim 3 wherein each said actuator is oriented generally parallel to the corresponding said inlet deflector and is powered by one of hydraulic, pneumatics or electricity.

5. The apparatus of claim 4 wherein each said actuator is detachable from the corresponding said movable member.

6. The apparatus of claim 5 further comprising:

a clean air inlet port to direct a flow of clean air underneath said wash decks to pass air through said wash decks to create cleaned particulate material discharged from said discharge edges, said clean air inlet port being located in said rear wall beneath said wash decks;

a Venturi zone located outboard of each respective discharge edge; and a cleaned product discharge port supported by said housing for the discharge of cleaned particulate material from the housing.

7. The apparatus of claim 5 further comprising a pair of secondary wash decks supported within said housing beneath, respectively, the discharge ends of said primary wash decks to receive the discharge of said particulate material off said discharge ends through the corresponding said Venturi zones.

8. An inlet deflector assembly for a dedusting apparatus having a housing, an infeed opening directing a flow of contaminated particulate material into the housing, and a wash deck extending downwardly and outwardly therefrom to a discharge edge, the inlet deflector assembly comprising:

a fixed member extending between a front wall of said housing and a rear wall of said housing and being mounted on a top member of said housing, said fixed member having a planar surface terminating in a spaced relationship with said wash deck;

a movable member slidable toward and away from said wash deck along said planar surface of said fixed member and being positionable relative to said wash deck between a maximum spacing position and a minimum spacing position at which said movable member does not engage said wash deck but is sufficiently close that the passage of contaminated particulate material is not permitted past said movable member; and an actuator connected to said movable member to power the movement of said movable member relative to said fixed member along said planar surface.

9. The inlet deflector assembly of claim 8 wherein said movable member comprises:

a planar portion supported on said fixed member and being oriented parallel-to said planar surface thereof;

a trailing leg extending downwardly from said planar portion and being oriented generally parallel to said wash deck, said trailing leg being operable to direct the particulate material into a laminar flow once said particulate material has moved past said planar portion; and a linear tab extending generally parallel to said planar portion from said trailing leg to be positionable adjacent said wash deck to define a gap relative to said wash deck when said movable member is moved relative to said fixed member.

10. The inlet deflector assembly of claim 9 wherein said fixed member is oriented diagonally relative to said housing such that said linear tab is movable toward and away from said wash deck at substantially right angles thereto.

11. The inlet deflector assembly of claim 10 wherein said actuator is oriented generally parallel to said inlet deflector and is powered by one of hydraulic, pneumatics or electricity.

12. The inlet deflector assembly of claim 11 wherein said actuator is detachable from the corresponding said movable member.

13. The inlet deflector assembly of claim 12 wherein said dedusting apparatus includes a pair of wash decks meeting at an apex beneath said infeed opening, said wash decks extending downwardly and outwardly to opposing sides of said apex, said inlet deflector assembly including one said fixed member, one said movable member and one said actuator for each said wash deck.

14. The inlet deflector assembly of claim 13 wherein the positioning of both said movable members into said minimum spacing position allowing an accumulation of contaminated particulate material between said movable members and above said wash decks to fully load said wash decks along a width dimension thereof when said movable member is moved above said minimum spacing position.

15. A particulate material dedusting apparatus for cleaning unwanted debris from the particulate material, comprising:

a housing having a front wall, a rear wall and a top member;

a central infeed opening directing a flow of contaminated particulate material into the housing;

a pair of primary wash decks joined at an apex and extending downwardly and outwardly therefrom to opposing discharge edges;

an inlet deflector corresponding to each of said wash decks, each said inlet deflector being movable toward and away from the corresponding said wash deck to vary an spacing between said inlet deflector and the corresponding said wash deck from a maximum spacing position to a minimum spacing position, said minimum spacing position placing said inlet deflector adjacent the corresponding said wash deck to prevent the passage of contaminated particulate material past said inlet deflector, each said inlet deflector including:

a fixed member extending between said front wall and said rear wall and being mounted on said top member of said housing, said fixed member terminating in a spaced relationship with the corresponding said wash deck;

a movable member slidable along said fixed member, each said movable member including a planar portion supported on said fixed member and being oriented parallel thereto; a trailing leg extending downwardly from said planar portion and being oriented generally parallel to said wash deck, said trailing leg being operable to direct the particulate material into a laminar flow once said particulate material has moved past said planar portion; and a linear tab extending generally parallel to said planar portion from said trailing leg to be positionable adjacent said wash deck to define a gap relative to said wash deck when said movable member is moved relative to said fixed member, said movable member being positionable between said maximum spacing position and said minimum spacing position at which the passage of contaminated particulate material is not permitted past said movable member; and an actuator connected to each said inlet deflector to power movement of said movable member relative to said fixed member between said maximum spacing position and said minimum spacing position;

a clean air inlet port to direct a flow of clean air underneath said wash decks to pass air through said wash decks to create cleaned particulate material discharged from said discharge edges, said clean air inlet port being located in said rear wall beneath said wash decks;

a Venturi zone located outboard of each respective discharge edge; and a cleaned product discharge port supported by said housing for the discharge of cleaned particulate material from the housing.

16. The apparatus of claim 15 wherein each said inlet deflector extends between said front wall and said rear wall such that the movement of said deflectors to said minimum spacing permitting an accumulation of said contaminated particulate material between said inlet deflectors and above said wash decks.

17. The apparatus of claim 16 wherein each said fixed member is oriented diagonally relative to said housing such that said linear tab is movable toward and away from the corresponding said wash deck at substantially right angles thereto, each said actuator being detachable from the corresponding said movable member and being powered by one of hydraulic, pneumatics or electricity.

* * * * *